US006819633B2

(12) United States Patent
Shimizu et al.

(10) Patent No.: US 6,819,633 B2
(45) Date of Patent: Nov. 16, 2004

(54) BRAKING WITHOUT STOPPING GENERATOR FOR TIMEPIECE AND OTHER ELECTRONIC UNITS

(75) Inventors: Eisaku Shimizu, Okaya (JP); Kunio Koike, Matsumoto (JP); Hidenori Nakamura, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 179 days.

(21) Appl. No.: 10/079,658

(22) Filed: Feb. 20, 2002

(65) Prior Publication Data

US 2002/0117918 A1 Aug. 29, 2002

(30) Foreign Application Priority Data

Feb. 28, 2001 (JP) ..... 2001-054287

(51) Int. Cl.[7] ..... G04B 1/00; G04C 3/00
(52) U.S. Cl. ..... 368/204; 368/203
(58) Field of Search ..... 368/203–204

(56) References Cited

U.S. PATENT DOCUMENTS

| | | | | |
|---|---|---|---|---|
| 6,154,422 | A | * 11/2000 | Shinkawa et al. | 368/204 |
| 6,194,878 | B1 | * 2/2001 | Schafroth | 322/29 |
| 6,373,789 | B2 | * 4/2002 | Koike et al. | 368/204 |
| 6,483,276 | B1 | * 11/2002 | Shimizu et al. | 322/24 |
| RE38,110 | E | * 5/2003 | Shinkawa et al. | 368/64 |
| 6,633,511 | B1 | * 10/2003 | Moteki et al. | 368/204 |

FOREIGN PATENT DOCUMENTS

| | | |
|---|---|---|
| JP | 11-101879 | 4/1999 |
| JP | 11-109061 | 4/1999 |
| JP | 11-153679 | 6/1999 |
| JP | 2000-346964 | 12/2000 |
| JP | 2001-51070 | 2/2001 |

* cited by examiner

*Primary Examiner*—Randy W. Gibson
*Assistant Examiner*—Michael L. Lindinger
(74) *Attorney, Agent, or Firm*—Mark P. Watson

(57) ABSTRACT

To provide an electronic unit which can prevent brake control from stopping a generator. An electronically controlled mechanical timepiece, which is an electronic unit, includes a generator 2 driven by a coil spring 1 to generate electric power, and a rotation control unit 50 driven by electric energy of the generator to control the rotation period of the generator 2. The rotation control unit 50 is provided with a brake control unit 55 for comparing a reference signal fs with a rotation-detection signal FG1 corresponding to the rotation period of the generator 2 to apply brake control to the generator 2, and a generator-stop preventing unit 56 for setting the amount of brake to be applied to the generator 2 to a first brake setting value to prevent the generator 2 from being stopped, when the rotation period of the generator 2 is equal to or longer than a first setting period which is longer than a reference period. When the rotation period of the generator 2 becomes long, the generator 2 is controlled by the first brake setting value. The first brake setting value is a small amount of braking, such as zero, and can prevent the generator 2 from being stopped.

10 Claims, 8 Drawing Sheets

(FIG. 1)
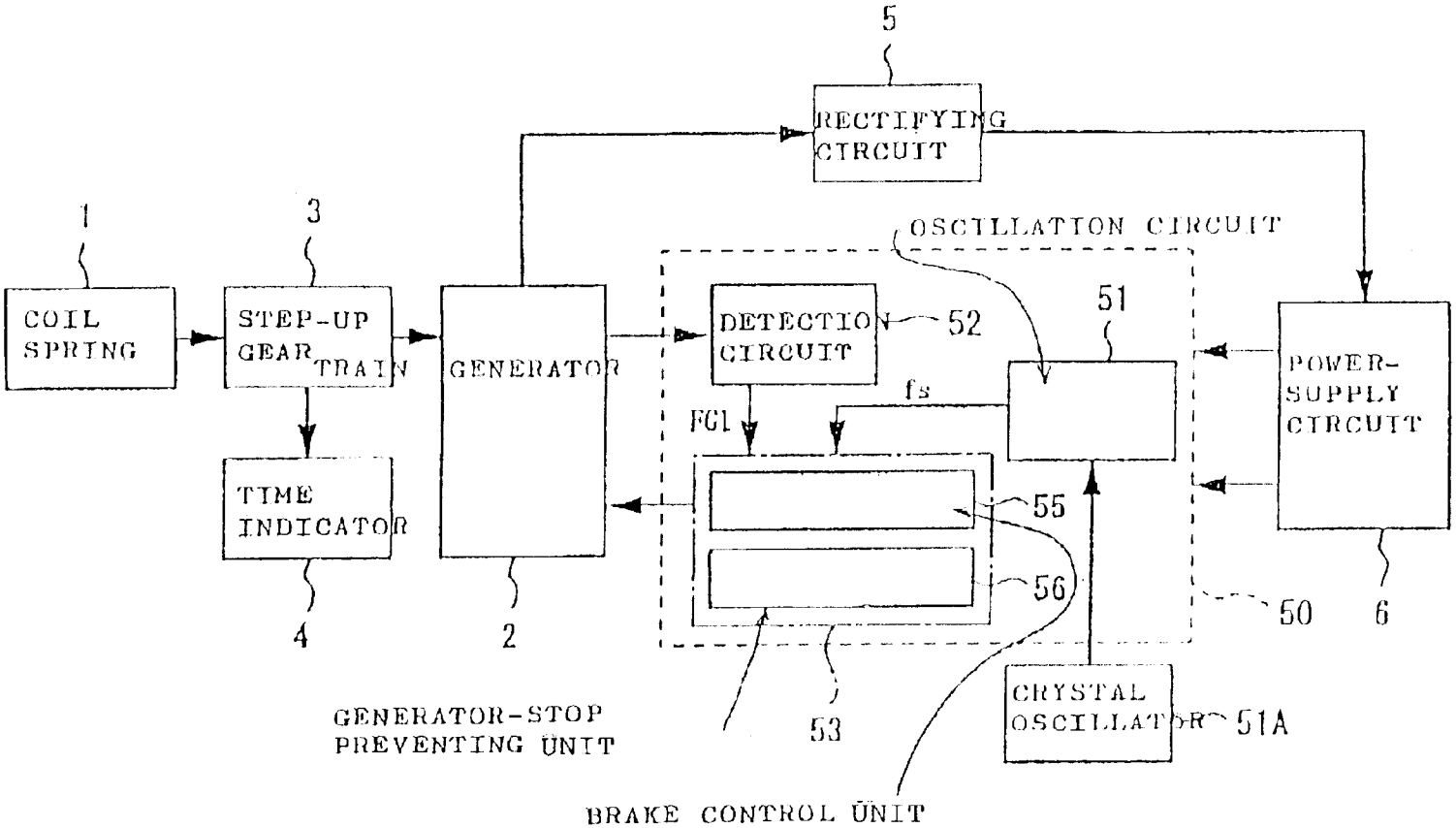

(FIG. 2)
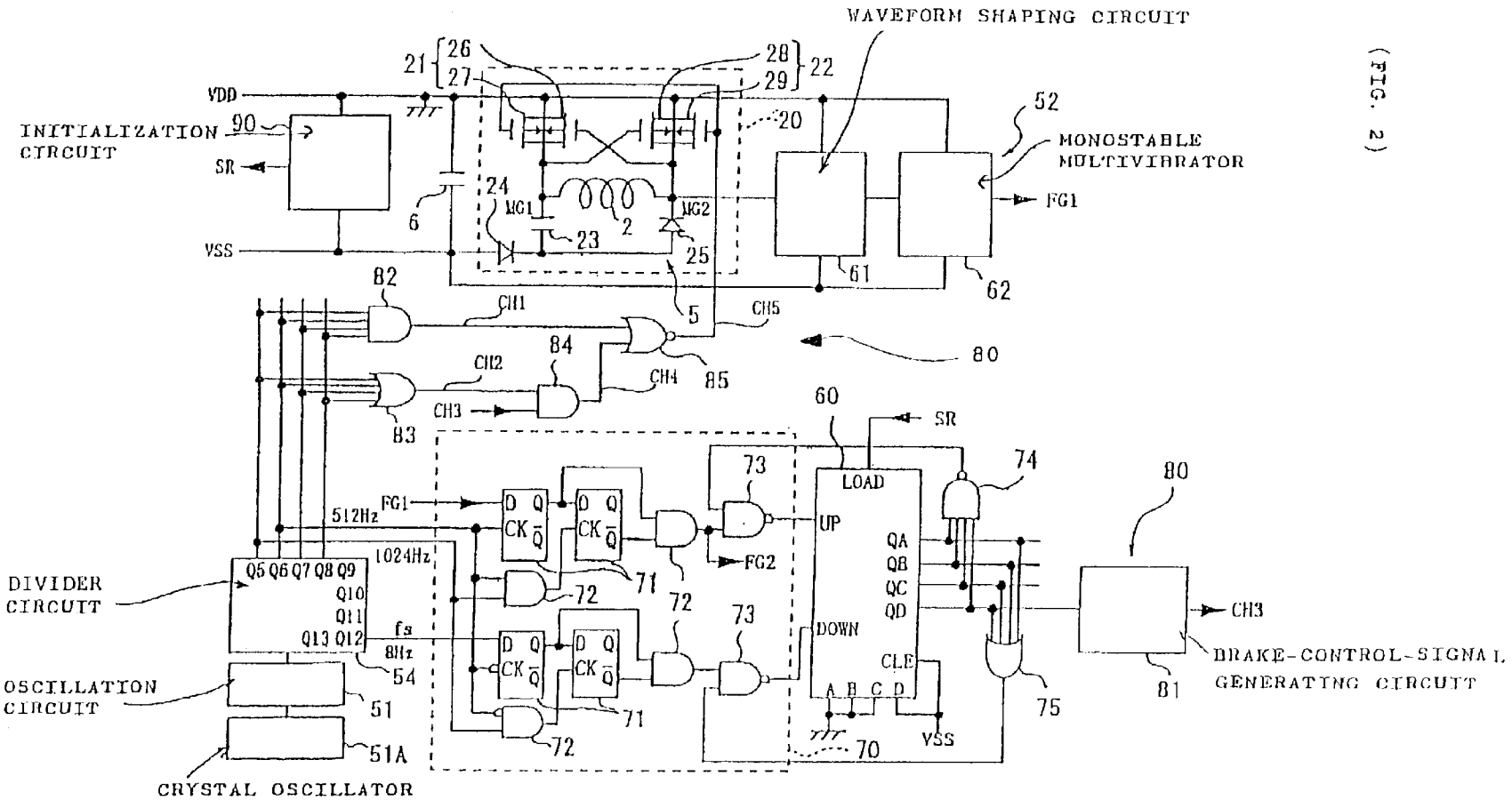

(FIG. 3)
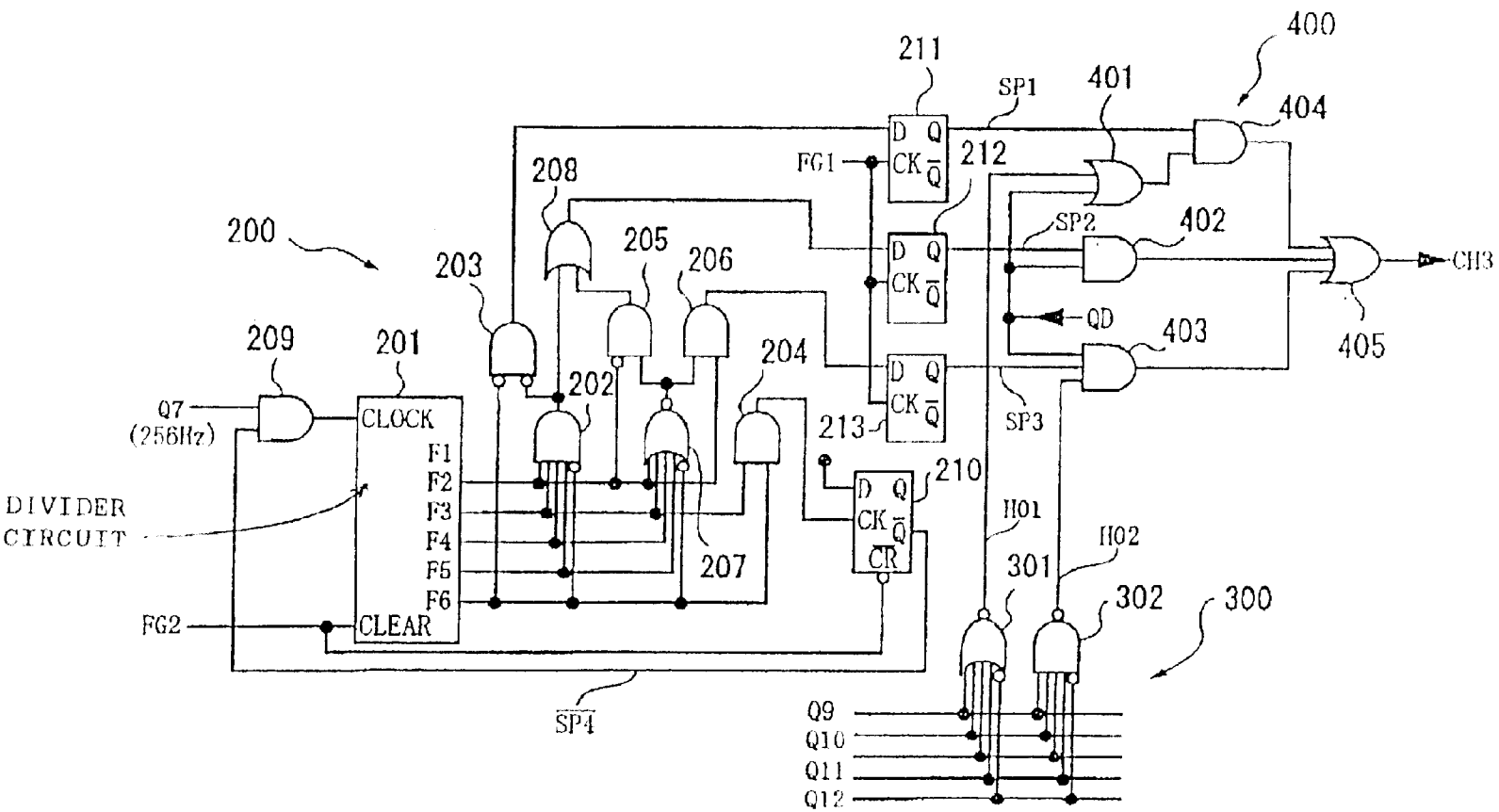

(FIG. 4)
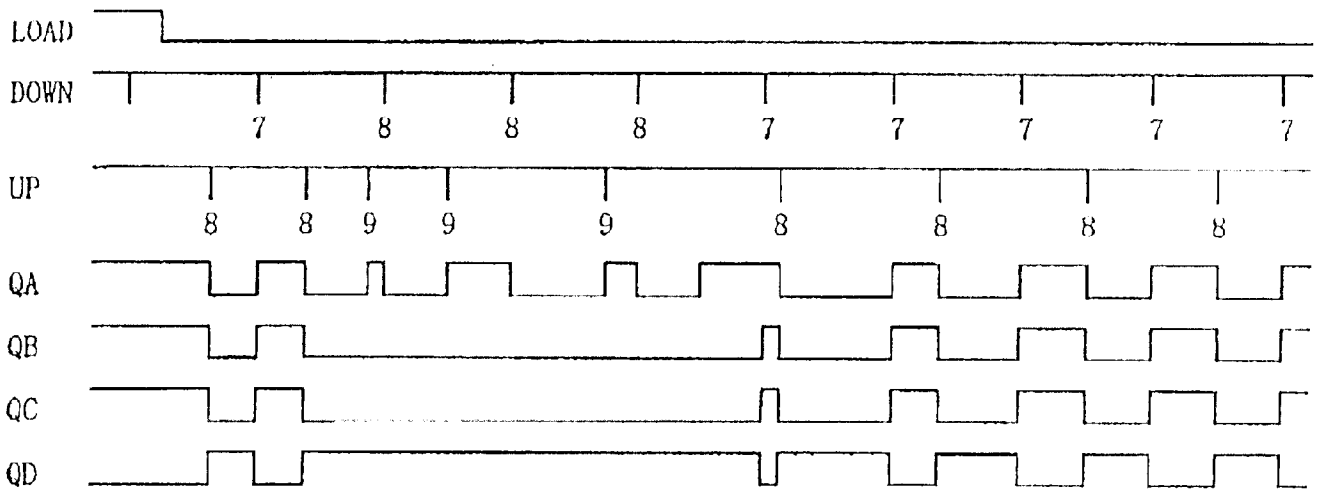

(FIG. 5)
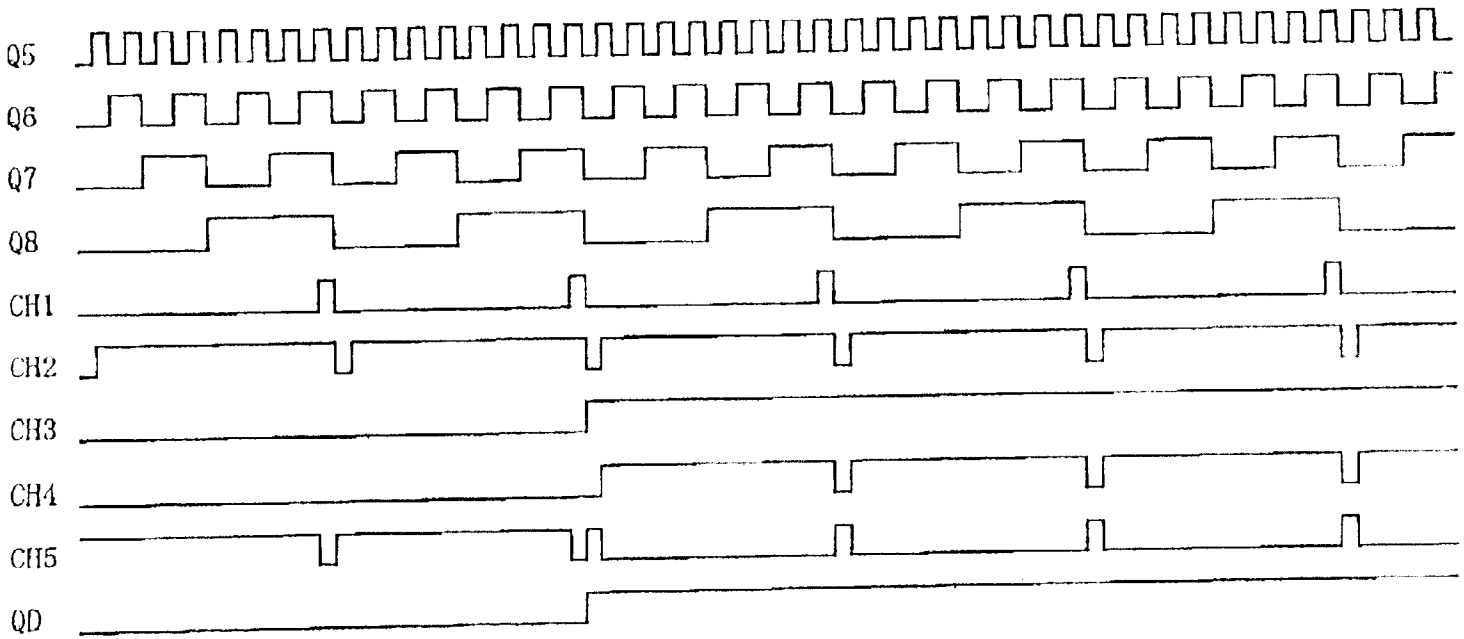

(FIG. 6)
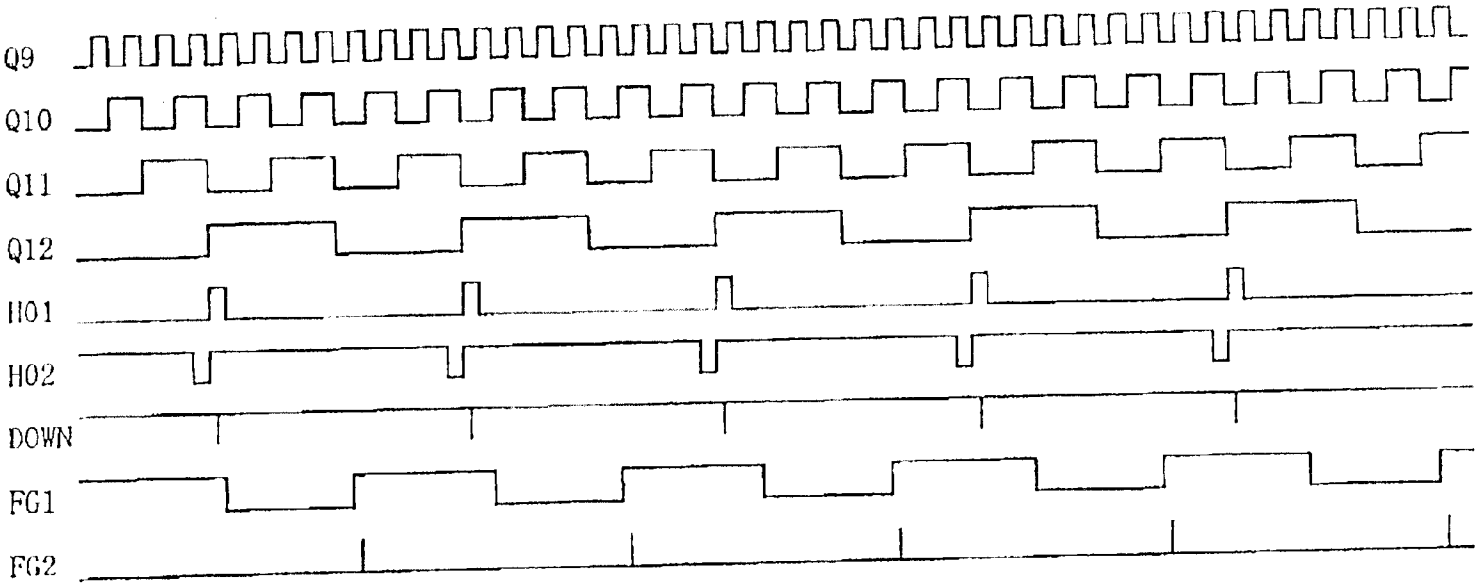

(FIG. 7)
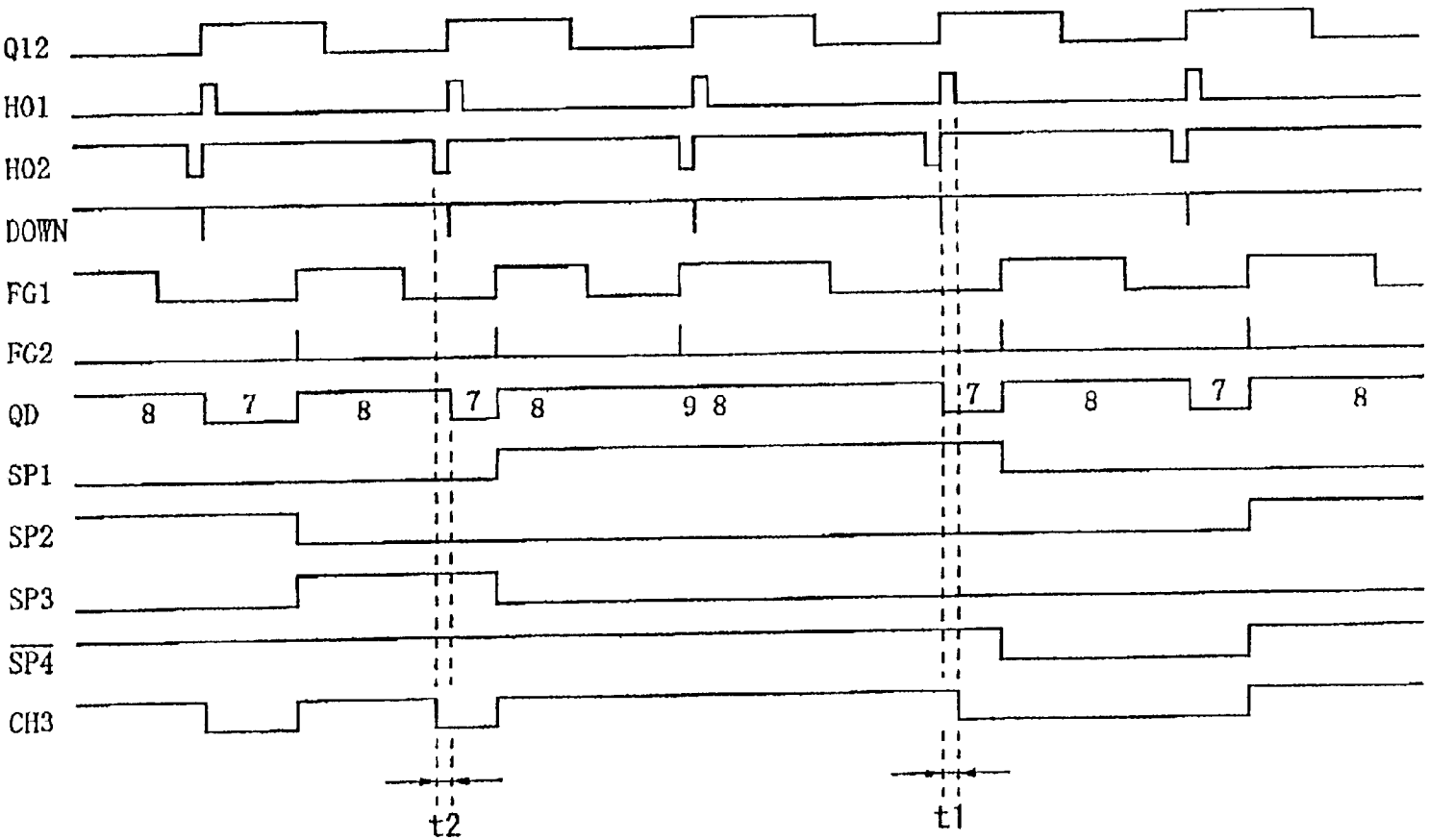

(FIG. 8)
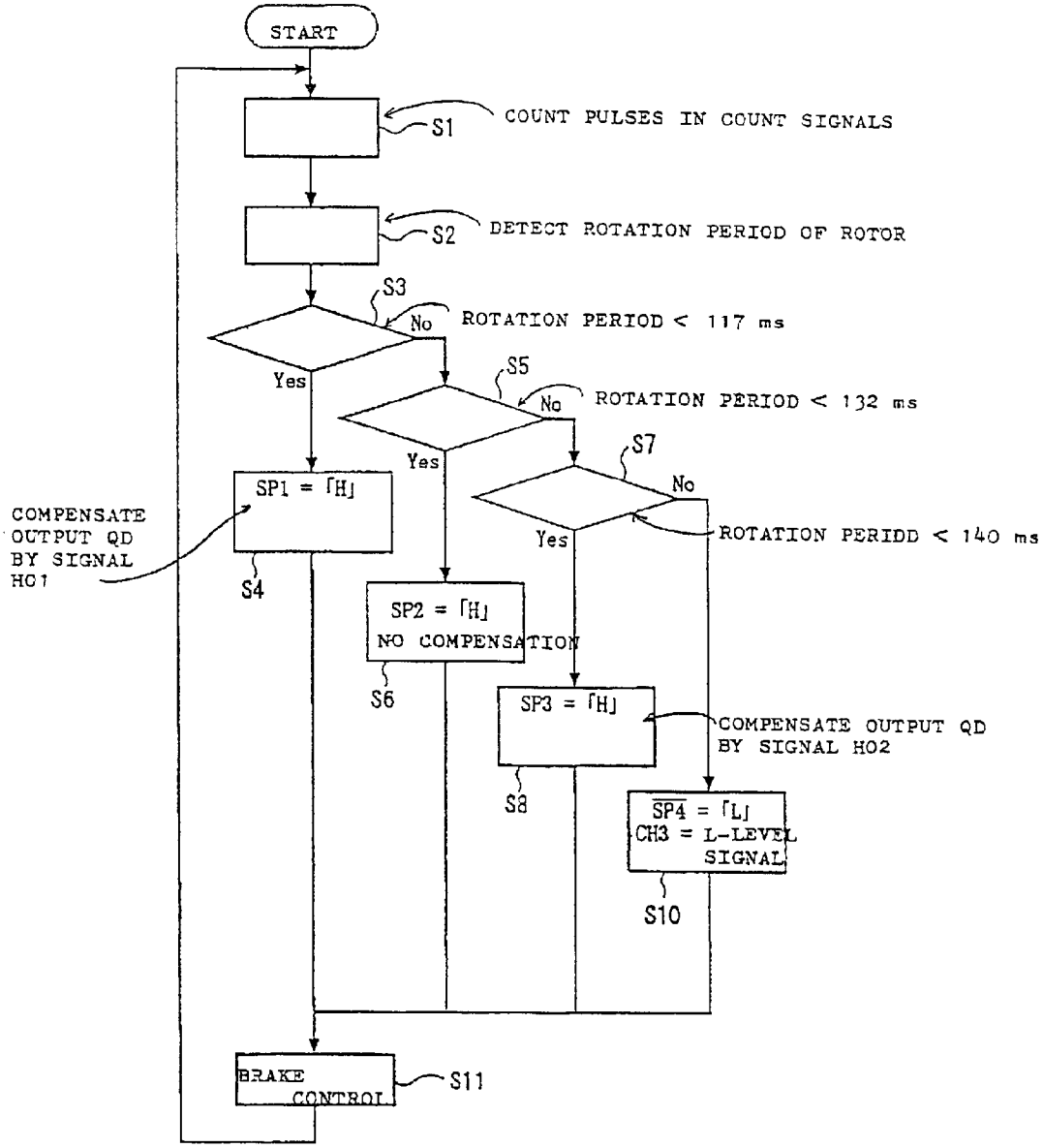

BRAKING WITHOUT STOPPING GENERATOR FOR TIMEPIECE AND OTHER ELECTRONIC UNITS

BACKGROUND OF THE INVENTION

1. Field of the Invention

The present invention relates to electronic units, electronically controlled mechanical timepieces, control programs for electronic units, recording media recording the programs, control methods for electronic units, and methods of manufacture for electronic units, and more particularly, to an electronic unit including a mechanical energy source, a generator driven by the mechanical energy source to generate induction electric power to supply electrical energy, and a rotation control unit driven by the electrical energy to control the rotation period of the generator.

2. Description of the Related Art

Japanese Examined Patent Publication No. Hei-7-119812 describes an electronically controlled mechanical timepiece in which mechanical energy obtained when a coil spring is released is converted to electrical energy by a generator, a rotation control unit is operated by the electrical energy to control current flowing through a coil of the generator, and hands fixed to a gear train are correctly driven to indicate the correct time.

In such an electronically controlled mechanical timepiece, a reference signal generated according to a signal sent from a time reference source such as a crystal oscillator is compared with a rotation detection signal corresponding to the rotation period of the generator to set the amount (for example, a period in which a brake is applied) of brake to be applied to the generator to adjust the speed of the generator.

In other words, when the rotation period of the generator becomes shorter than the period of the reference signal, the speed of the generator is adjusted such that a brake is applied for a longer period determined according to the phase difference thereof to make the rotation period of the generator longer to match the reference period.

When the rotation period of the generator rapidly becomes short due to a disturbance or for some other reason, however, brake control applies a brake for a long period in order to eliminate an indication error, so that the rotation period of the generator is made extremely long, which in effect stops the generator.

Therefore, although the rotation period temporarily becomes short due to a disturbance or for some reason, since a large amount of brake (long brake period) is applied according to the speed, the generator may be made to stop.

Once the generator stops, it is necessary to apply a very large torque to restart the generator due to the effect of cogging torque. Therefore, unless the coil spring is fully wound or nearly fully wound, the generator remains stopped and a duration time become short.

Even when the coil spring is fully wound and therefore the generator can be restarted, since it takes some time until the generator starts rotating, hands operating together with the rotation of the generator have an indication error.

A difficulty in which the generator is stopped due to such brake control may occur not only in electronically controlled mechanical timepieces but also in cases in which each operating section, such as a drum in a music box or a pendulum in a metronome, is operated at a high precision by precise brake control in various electronic units, such as music boxes, metronomes, toys, and electric shavers, having portions in which rotation is controlled by a mechanical energy source, such as a coil spring or a rubber band.

OBJECTS OF THE INVENTION

An object of the present invention is to provide an electronic unit, an electronically controlled mechanical timepiece, a control method for an electronic unit, and a method of manufacture for an electronic unit which prevent brake control from causing a generator to stop.

SUMMARY OF THE INVENTION

In one aspect of the present invention, an electronic unit including a mechanical energy source, a generator driven by the mechanical energy source to generate induction electric power to supply electrical energy, and a rotation control unit driven by the electrical energy to control the rotation period of the generator, the rotation control unit comprises: a brake control unit that compares a reference signal, generated according to a signal sent from a time reference source, with a rotation detection signal corresponding to the rotation period of the generator to apply brake control to the generator; and a generator-stop preventing unit that sets the amount of brake applied to the generator to a first brake setting value when a measured rotation period of the generator is equal to or longer than a first setting period, which is longer than a reference period, to prevent the generator from stopping.

In this case, it is preferred that the first brake setting value be set to a value which makes the amount of brake zero or the first brake setting value be set to a value equal to or less than the minimum amount of brake among a plurality of amounts of brake which can be set by the brake control unit.

In the present invention, when the rotation period of the generator becomes long and reaches the first setting period or longer, the amount of brake is set to the first brake setting value to control the generator. Since the first brake setting value is, for example, an amount of brake as small as zero or the minimum amount of brake or less, if control is made with the first brake setting value, unless the coil spring is unwound, the generator is prevented from being stopped.

It is also preferred that the generator-stop preventing unit sets the amount of brake applied to the generator to the first brake setting value in synchronization with the rotation period of the generator.

In such a structure, since the amount of brake can be immediately set to the first brake setting value if a rotation period equal to or longer than the first setting period is detected, quick control can be made.

It is further preferred that a period at which the generator is stopped, unless the amount of brake applied to the generator is switched to the first brake setting value, be selected as an upper limit, a period at which the generator vibrates when the amount of brake applied to the generator is switched to the first brake setting value be selected as a lower limit, and the first setting period be set to a period between the upper limit and the lower limit.

"The generator vibrates" is a state in which a brake is applied for one reference period or more and a state in which a brake is not applied for one reference period are alternately repeated. In other words, it means that a fluctuation range of the actual rotation period of the generator against the reference period of the generator is large. When the reference period is 1/(8 Hz), for example, a wide range means a range of about 1/(10 Hz) to 1/(6 Hz), namely, a fluctuation range of, for example, 20% or more against the reference period.

Therefore, a state in which the generator does not vibrate is a state in which some amount of brake is applied in one period, and the fluctuation range of the rotation period of the generator falls in a predetermined zone (such as, less than 15% of the reference period, or 1/((8±1) Hz)).

When the first setting period, in which the amount of brake is set to the first brake setting value, which indicates a small brake power, is made short (close to the reference period), since a brake becomes ineffective or very small before the brake power is sufficiently applied, the generator is likely to vibrate.

On the other hand, when the first setting period is made long (very much larger than the reference period), the generator may be stopped before the amount of brake is changed to the first brake setting value.

Therefore, when the first setting period is set to a period which causes the generator neither to vibrate nor to stop, according to an electronic unit to which the present invention is applied, control is positively achieved so that a vibration state or a stop state of the generator does not occur.

The present invention is also preferably applied to an electronically controlled mechanical timepiece with a time indication unit operated with the rotation of the generator. The time indication unit indicates the time with hands, for example, coupled with an energy transfer unit, such as a gear train that transfers mechanical energy from a mechanical energy source to the generator.

According to an electronically controlled mechanical timepiece of the present invention, since the generator is prevented from being stopped, the duration is long, and re-activation of the generator after it is stopped can be prevented. Therefore, an indication error of the time indication unit (hands) is eliminated.

It is preferred that the electronic unit be a time measuring unit, a music box, or a metronome. A condition that the generator is stopped due to disturbance does not occur, and a time measuring unit, a music box, or a metronome in which rotation control is correctly performed can be provided.

The present invention also includes a control program, a recording medium recording the control program and a control method for an electronic unit comprising a mechanical energy source, a generator driven by the mechanical energy source to generate induction electric power to supply electrical energy, and a rotation control unit driven by the electrical energy to control the rotation period of the generator, in which the rotation control unit: compares a reference signal, generated according to a signal sent from a time reference source, with a rotation detection signal corresponding to the rotation period of the generator to apply brake control to the generator; and sets the amount of brake applied to the generator to a first brake setting value when a measured rotation period of the generator is equal to or longer than a first setting period, which is longer than a reference period, to prevent the generator from stopping.

When a control program according to the present invention, provided by a recording medium or through a communication channel, such as the Internet, is installed into an electronic unit, if the rotation period of the generator becomes long and reaches the first setting period or longer, since brake control is performed with the amount of brake used at the first brake setting value, the generator is positively prevented from being stopped. Therefore, correct rotation control is always performed in an operation state.

In addition, since this program can be installed into an electronic unit by a recording medium, such as a CD-ROM, or through a communication channel, such as the Internet, the first setting period can be most appropriately and easily set according to the characteristic of the electronic unit. Correct rotation control is thereby performed.

The present invention also includes a method of manufacturing an electronic unit comprising a mechanical energy source, a generator driven by the mechanical energy source to generate induction electric power to supply electrical energy, and a rotation control unit driven by the electrical energy to control the rotation period of the generator, the method comprising: selecting as an upper limit a period at which the generator is stopped unless the amount of brake applied to the generator is switched to a first brake setting value, selecting as a lower limit a period at which the generator vibrates when the amount of brake applied to the generator is switched to the first brake setting value, and setting a first setting period to a period between the upper limit and the lower limit, such that the electronic unit operates to: compare a reference signal, generated according to a signal sent from a time reference source, with a rotation detection signal corresponding to the rotation period of the generator to apply brake control to the generator; and set the amount of brake applied to the generator to a first brake setting value when a measured rotation period of the generator is equal to or longer than a first setting period, which is longer than a reference period, to prevent the generator from stopping.

When the first setting period, which serves as a reference for setting the amount of brake to the first brake setting value, which indicates a small amount of brake, is set to an inappropriate value, vibration occurs or the generator is stopped.

A period at which the generator vibrates or stops is changed according to the type of an electronic unit and a brake-force setting. According to a method manufacturing of the present invention, since each period is appropriately selected, the first setting period can be appropriately set so that the generator does not vibrate or the generator does not stop.

BRIEF DESCRIPTION OF THE DRAWINGS

FIG. 1 is a block diagram showing a main section of an electronically controlled mechanical timepiece according to an embodiment of the present invention.

FIG. 2 is a circuit diagram showing the structure of the electronically controlled mechanical timepiece according to the embodiment.

FIG. 3 is a circuit diagram showing the structure of a brake-control-signal generating circuit according to the embodiment.

FIG. 4 is a timing chart for an up/down counter according to the embodiment.

FIG. 5 is a timing chart for a chopper-signal generating section according to the embodiment.

FIG. 6 is another timing chart for the chopper-signal generating section according to the embodiment.

FIG. 7 is a timing chart for a brake-control-signal generating circuit according to the embodiment.

FIG. 8 is a flowchart showing an operation according to the embodiment.

DESCRIPTION OF THE PREFERRED EMBODIMENTS

FIG. 1 is a block diagram of an electronically controlled mechanical timepiece according to an embodiment of the present invention.

The electronically controlled mechanical timepiece is provided with a coil spring 1 serving as a mechanical energy source, a step-up gear train 3 serving as an energy transfer unit for transferring the torque of the coil spring 1 to a generator 2, and a time indicator (e.g. hands) 4 coupled with the step-up gear train 3.

The generator 2 is driven by the coil spring 1 through the step-up gear train 3, and generates induction electric power to supply electrical energy. The AC output of the generator 2 is boosted and rectified by a rectifying circuit 5 that performs boost rectification, full-wave rectification, half-wave rectification, transistor rectification, and other forms of rectification, and charges a power-supply circuit 6 formed of capacitors and associated circuitry.

In the present embodiment, also as shown in FIG. 2, the generator 2 is provided with a brake circuit 20 that includes the rectifying circuit 5. The brake circuit 20 has a first switch 21 connected to a first AC input terminal MG1 to which an AC signal (AC current) generated by the generator 2 is input, and a second switch 22 connected to a second AC input terminal MG2 to which the AC signal is also input; and turns on these switches 21 and 22 at the same time to short-circuit the first and second AC input terminals MG1 and MG2 to make a closed-loop state to apply a short-circuit brake.

The first switch 21 is formed such that a first p-channel field-effect transistor (FET) 26 of which the gate is connected to the second AC input terminal MG2 and a second field-effect transistor 27 which receives at the gate a chopper signal (chopper pulses) CH5 from a chopper-signal generating section 80, described later, are connected in parallel.

The second switch 22 is formed such that a third p-channel field-effect transistor (FET) 28 of which the gate is connected to the first AC input terminal MG1 and a fourth field-effect transistor 29 which receives at the gate the chopper signal CH5 from the chopper-signal generating section 80 are connected in parallel.

The double-voltage rectifying circuit 5 is formed of a booster capacitor 23, diodes 24 and 25, and the switches 21 and 22, all of which are connected to the generator 2. The diodes 24 and 25 must be uni-directional devices through which a current flows in one direction, and can be any type of unidirectional device. Especially in electronically controlled mechanical timepieces, since the generator 2 has a small electromotive force, it is preferred that Schottky barrier diodes or silicon diodes, which have a low forward-drop voltage Vf and a low reverse leak current, be used as the diodes 24 and 25. A DC signal rectified by the rectifying circuit 5 is accumulated in the power-supply circuit (capacitor) 6.

The brake circuit 20 is controlled by a rotation control unit 50, which is driven by electric power supplied from the power-supply circuit 6. The rotation control unit 50 is provided with an oscillation circuit 51, a detection circuit 52, and a control circuit 53, as shown in FIG. 1.

The oscillation circuit 51 uses a crystal oscillator 51A serving as a time reference source to output an oscillation signal (e.g., 32768 Hz). This oscillation signal is scaled down to a signal having a predetermined period by a divider circuit 54 formed of 12-stage flip-flops. The output Q12 of the 12th stage of the divider circuit 54 is an 8-Hz reference signal fs.

The detection circuit 52 is formed of a waveform-shaping circuit 61 connected to the generator 2, and a monostable multivibrator 62. The waveform-shaping circuit 61 is formed of an amplifier and a comparator, and converts a sine-wave signal to a rectangular-wave signal. The monostable multivibrator 62 serves as a bandpass filter which passes only pulses having a predetermined period or a shorter period, and outputs a rotation-detection signal FG1 from which noise has been removed.

The control circuit 53 is provided with a brake control unit 55 serving as brake control means and a generator-stop preventing unit 56 serving as generator-stop preventing means, as shown in FIG. 1. The brake control unit 55 includes an up/down counter 60, a synchronization circuit 70, and the chopper-signal generating section 80, as shown in FIG. 2.

The rotation detection signal FG1 sent from the detection circuit 52 and the reference signal fs sent from the divider circuit 54 are input through the synchronization circuit 70 to the up-count input and the down-count input of the up/down counter 60, respectively.

The synchronization circuit 70 is formed of four flip-flops 71, AND gates 72, and NAND gates 73, and uses the fifth output Q5 (1024 Hz) and the sixth output Q6 (512 Hz) of the divider circuit 54 to synchronize the rotation detection signal FG1 with the reference signal fs (8 Hz) and to perform adjustment such that signal pulses do not overlap.

The up/down counter 60 is a four-bit counter. A signal based on the rotation detection signal FG1 is input to the up-count input from the synchronization circuit 70, and a signal based on the reference signal fs is input to the down-count input from the synchronization circuit 70. Therefore, pulses in the reference signal fs and in the rotation detection signal FG1 are counted, and at the same time, the difference therebetween is calculated.

The up/down counter 60 is provided with four data input terminals (preset terminals) A to D. An H-level signal is input to the terminals A to C, so that the initial value (preset value) of the up/down counter 60 is "7."

The LOAD input terminal of the up/down counter 60 is connected to an initialization circuit 90, which is connected to the power-supply circuit 6, for outputting a system reset signal SR according to the voltage of the power-supply circuit 6. In the present embodiment, the initialization circuit 90 is configured so as to output the H-level signal until the charged voltage of the power-supply circuit 6 reaches a predetermined voltage, and to output an L-level signal when the charged voltage is equal to or higher than the predetermined voltage.

Since the up/down counter 60 does not receive an up/down input until the LOAD input becomes the L level, that is, until the system reset signal SR is output, the count "7" of the up/down counter 60 is maintained.

The up/down counter 60 has four-bit outputs QA to QD. Therefore, the fourth-bit output QD is an L-level signal when the count is seven or less, and is an H-level signal when the count is eight or higher. This output QD is sent to the chopper-signal generating circuit 80.

The outputs of a NAND gate 74 and an OR gate 75 to which the outputs QA to QD are input, are connected respectively to NAND gates 73 to which the outputs of AND gates 72 of the synchronization circuit 70 are input. Therefore, when the count reaches "15" if a plurality of up-count-signal inputs continues, for example, the NAND gate 74 outputs an L-level signal. Even when an up-count signal is further input to the NAND gate 73, this input is cancelled, and the up/down counter 60 does not receive an up-count signal any more. In the same way, when the count reaches "0," since the OR gate 75 outputs an L-level signal, the input of a down-count signal is cancelled. With this circuit configuration, the count is neither changed from "15" to "0", nor from "0" to "15."

The chopper-signal generating circuit 80 is formed of an AND gate 82 which uses the outputs Q5 to Q8 of the divider circuit 54 to output a first chopper signal CH1, an OR gate 83 which uses the outputs Q5 to Q8 of the divider circuit 54 to output a second chopper signal CH2, a brake-control-signal generating circuit 81 which uses the output QD of the up/down counter 60 and others to output a chopper signal CH3 serving as a brake-control signal, an AND gate 84 for receiving the chopper signals CH2 and CH3, and a NOR gate 85 for receiving the output CH4 of the AND gate 84 and the output CH1.

The output CH5 of the NOR gate 85 in the chopper-signal generating section 80 is input to the gates of the p-channel transistors 27 and 29. Therefore, while the chopper output CH5 has the L level, the transistors 27 and 29 are maintained at an ON state, the generator 2 is short-circuited, and a brake is applied.

While the chopper output CH5 has the H level, the transistors 27 and 29 are maintained at an OFF state, and a brake is not applied to the generator 2. Therefore, chopper control can be applied to the generator 2 by a chopper output signal CH5.

The duty cycle of each of the chopper signals CH1 and CH2 is the ratio of a period in which a brake is applied to the generator 2 to one period of the chopper signal, and is, in the present embodiment, the ratio of a period in which the chopper signal has the H level to one period of the signal.

The brake-control-signal generating circuit 81 is formed of a rotation-period detection circuit 200, a brake-amount compensation circuit 300, and a signal selection circuit 400, as shown in FIG. 3.

The rotation-period detection circuit 200 includes an AND gate 209 to which the output Q7 (256 Hz) of the divider circuit 54 and the inverted output XQ (indicated by Q having a bar thereabove in the figure) of a flip-flop 210, described later, are input; a six-stage divider circuit 201 to which the output of the AND gate 209 is input as a clock, and the output FG2 of the AND gate 72 is input as a clear signal; AND gates 202 to 206; a NOR gate 207;, and an OR gate 208.

The outputs F2 to F5 of the divider circuit 201 and the inverted signal of the output F6 thereof are input to both the AND gate 202 and the NOR gate 207.

The AND gate 203 receives the inverted signal of the output of the AND gate 202 and the inverted signal of the output F6. The AND gate 204 receives the outputs F3 and F6. The AND gate 205 receives the inverted signal of the output F2 and the output of the NOR gate 207. The AND gate 206 receives the output F2 and the output of the NOR gate 207.

The OR gate 208 receives the outputs of the AND gates 202 and 205.

The output FG2 is a pulse signal that is output almost in synchronization with the rise of the rotation-detection signal FG1, namely, is output once per one period of the rotation-detection signal FG1.

The rotation-period detection circuit 200 is provided with the flip-flop 210 in which the output of the AND gate 204 is input to the clock input thereof, the inverted signal of the output FG2 is input to the clear input thereof, and an always-H-level signal is input to the data input thereof; and flip-flops 211 to 213 in which the outputs of the AND gate 204, the OR gate 208, and the AND gate 206 are input to the data inputs thereof, respectively, and the rotation-detection signal FG1 is input to the clock inputs thereof.

The rotation-period detection circuit 200 detects the rotation period of the rotation-detection signal FG1, and outputs the detected rotation period from the flip-flops 211 to 213.

More specifically, in the present embodiment, an output SP1 is set to the H level when the rotation period of the rotor is shorter than 117 ms, and otherwise, is set to the L level. In the same way, an output SP2 is set to the H level only when the rotation period is equal to or longer than 117 ms and shorter than 132 ms, and an output SP3 is set to the H level only when the rotation period is equal to or longer than 132 ms and shorter than 140 ms. The output Q of the flip-flop 210 is set to the H level only when the rotation period is equal to or longer than 140 ms. Therefore, its inverted signal XQ (inverted signal XSP4 of SP4) usually has the H level and is set to the L level only when the rotation period is equal to or longer than 140 ms.

In other words, the rotation period can be detected in a total of four stages with the reference period (1/(8 Hz)=125 ms) being placed at the center; one stage in which the rotation period (117 to 132 ms) almost matches the reference period, one stage in which the rotation period (shorter than 117 ms) is shorter than the reference period, and two stages (132 to 140 ms, and 140 ms and longer) in which the rotation period is longer than the reference period.

The brake-amount compensation circuit 300 is formed of a NOR gate 301 and a NAND gate 302, and uses the outputs Q9 to Q12 of the divider circuit 54 to output compensation signals H01 and H02 shown in FIG. 6.

The signal selection circuit 400 is formed of an OR gate 401, AND gates 402 to 404, and an OR gate 405. The signal selection circuit 400 synthesizes the output QD of the up/down counter 60, the outputs SP1 to SP3, and the compensation signals H01 and H02, and adjusts the output QD by the compensation signal H01 or H02 corresponding to an H-level signal obtained from the outputs SP1 to SP3 to output a brake control signal CH3.

When the output SP2 has the H level, the output QD is not compensated and serves as is as the brake control signal CH3. When the rotation period is 140 ms or longer, since the outputs SP1 to SP3 all have the L level, the brake control signal CH3 also has the L level.

The compensation signals H01 and H02 compensate timing at which the brake control signal CH3 is changed from the H level to the L level according to the output QD of the up/down counter 60, that is, timing at which control (strong-brake control) in which a strong brake is applied is changed to control (weak-brake control) in which a weak brake is applied, according to the outputs SP1 to SP3 of the rotation-period detection circuit 200, that is, the rotation period of the rotor.

In other words, the compensation signal H01 is set so as to have the H level at the rising edge of the output Q12, and has the L level one period of Q8 (128 Hz), that is, about 7.8 ms, after the rising edge of the output Q12, as shown in FIG. 6 and FIG. 7.

On the other hand, the compensation signal H02 is set so as to have the L level one period of Q8 (128 Hz), that is, about 7.8 ms, before the rising edge of the output Q12, and to have the H level at the rising edge of the output Q12.

In the present invention, a strong brake and a weak brake are terms relative to each other, and a strong brake means that it has a stronger brake power than a weak brake. A specific brake power for each brake, that is, the duty cycle and frequency of a chopper brake signal, is set as appropriate to each practical application of the present invention.

An operation in the present embodiment will be described next by referring to the timing charts of FIG. 4 to FIG. 7, and a flowchart shown in FIG. 8.

When the generator 2 starts operating and the initialization circuit 90 sends an L-level system reset signal SR to the LOAD input of the up/down counter 60, the up/down counter 60 counts with an up-count signal based on the rotation-detection signal FG1, and a down-count signal based on the reference signal fs, as shown in FIG. 4, in step 1 (hereinafter called S1). These signals are set by the synchronization circuit 70 so as not to be input to the counter 60 at the same time.

Therefore, when the up-count signal is input, the count is changed from an initial count of "7" to "8" and an output QD having the H level is sent to the brake-control-signal generating circuit 81 of the chopper-signal generating section 80.

On the other hand, when the down-count signal is input, the count returns to "7" and an output QD having the L level is output.

The brake-control-signal generating circuit 81 of the chopper-signal generating section 80 uses the outputs Q4 to Q8 of the divider circuit 54 to output the chopper signals CH1 and CH2, as shown in FIG. 5

The brake control signal CH3 is output according to the output QD of the up/down counter 60, input to the brake-control-signal generating circuit 81. The brake-control-signal generating circuit 81 detects the rotation period of the rotor in units of periods in S2, and adds a predetermined compensation signal H01 or H02 to the brake control signal CH3 according to the detected rotation period to adjust a strong-brake time.

More specifically, also as shown in FIG. 7, when the rotation period of the rotor is shorter than 117 ms (shorter than the period of 125 ms of the reference signal fs (=8 Hz)) in S3, since SP1 has the H level, the brake control signal CH3 is a signal obtained by synthesizing the output QD and the compensation signal H01 in the OR gate 401, that is, a signal having a falling edge later than that of the output QD by the compensation signal H01 (time t1 in FIG. 7), in other words, a signal making a strong-brake period in which a strong brake is applied longer, in S4.

When the rotation period of the rotor falls in a range of 117 ms to 132 ms (is almost the same as the period of the reference signal) in S5, since SP2 has the H level, the brake control signal CH3 is the output QD as is in S6.

When the rotation period of the rotor falls in a range of 132 ms to 140 ms (is longer than the period of the reference signal) in S7, since SP3 has the H level, the brake control signal CH3 is a signal obtained by synthesizing the output QD and the compensation signal H02 in the AND gate 406, that is, a signal having a falling edge earlier than that of the output QD by the compensation signal H02 (time t2 in FIG. 7), in other words, a signal making the strong-brake period shorter, in S8.

When the rotation period of the rotor is equal to or longer than 140 ms in S9, since XSP4 has the L level, SP1 to SP3 all have the L level, and the brake control signal also has the L level in S10.

Brake control is performed in S11 with a brake-control signal CH3 compensated according to the rotation period.

More specifically, when the brake-control signal CH3 has the L level, the output CH4 also has the L level. Therefore, also as shown in FIG. 5, the output CH5 of the NOR gate 85 is a chopper signal obtained by inverting the output CH1, and in other words, has an H-level period (brake-off period) as long as 15/16 of the signal period and has an L-level period (brake-on period) as short as 1/16 of the signal period. The output CH5 is a chopper signal having a small (1/16) duty cycle (ratio of on-time of the switches 21 and 22 to their period), which performs weak-brake control. Therefore, weak-brake control, which gives priority to generating electric power, is applied to the generator 2.

On the other hand, when the brake-control signal CH3 has the H level (the count is "8" or higher), the chopper signal CH2 is output as is from the AND gate 84, and the output CH4 is equal to the chopper signal CH2. Therefore, the output CH5 of the NOR gate 85 is a chopper signal obtained by inverting the output CH2, and in other words, has an H-level period (brake-off period) as short as 1/16 of the signal period and has an L-level period (brake-on period) as long as 15/16 of the signal period. The output CH5 is a chopper signal having a large (15/16) duty cycle, which performs strong-brake control. Therefore, the chopper signal CH5 has a long L-level total time, where a short-circuit brake is applied to the generator 2. Strong-brake control is applied to the generator 2. Since the chopper signal CH5 has the H level at a constant period to turn off a short-circuit brake, chopper control is performed. Braking torque is increased while a reduction in generated electric power is suppressed.

Consequently, while the output QD of the up/down counter 60 has the H level, strong-brake control is performed with a chopper signal having a large duty cycle, and while the output QD has the L level, weak-brake control is performed with a chopper signal having a small duty cycle. In other words, strong-brake control and weak-brake control are switched by the up/down counter 60 serving as a brake control unit.

As described before, the period of the rotation detection signal FG1 of the rotor is detected by the rotation-period detection circuit 200, the rotation period is compared with the reference-signal period to classify the rotation period into four stages, almost equal, shorter (one stage), and longer (two stages), and according to this classification, a period in which a strong-brake control is performed by the brake control signal CH3, that is, a period in which the brake control signal CH3 has the H level, is adjusted.

More specifically, when the rotation period of the rotation-detection signal FG1 is shorter than the reference-signal period (shorter than 117 ms), the brake control signal CH3 is a signal making the strong-brake period longer by the compensation signal H01 from a falling edge of the output QD. Therefore, since a stronger brake than usual is applied to the rotor, the rotation period is quickly adjusted to the reference period.

When the rotation period of the rotation-detection signal FG1 is longer than the period of the reference signal (132 ms to 140 ms), the brake control signal CH3 is a signal making the strong-brake-control period shorter by the compensation signal H02 from a falling edge of the output QD. Therefore, since brake power applied to the rotor becomes weaker, the rotation speed of the rotor rises, and the rotation period is quickly adjusted to the reference period.

When such brake control is repeated, the rotation speed of the generator 2 approaches the specified rotation speed. As shown in FIG. 4, the up-count signal and the down-count signal are alternately input, and the state proceeds to a lock state in which the count shows "8" or "7" repeatedly. Strong-brake control or weak-brake control is repeated according to the count and the rotation period.

In a case in which the rotation period of the rotor becomes very short, and as a result, strong-brake control continues, when the rotation period of the rotor becomes equal to or longer than 140 ms, the brake control signal has the L level, irrespective of the output QD, until the rotation period of the rotor becomes shorter than 140 ms. Therefore, even if the output QD has the H level, when the rotation period of the rotor is short, since weak-brake control continues without being changed to strong-brake control, the rotor is positively prevented from being stopped.

Therefore, in the present embodiment, the brake-control-signal generating circuit 81, which includes the rotation-period detection circuit 200, the brake-amount compensation circuit 300, and the signal-selection circuit 400, constitutes a brake-amount compensation unit (brake-control unit 55) for compensating (applying the compensation signals H01 and H02) the amount of brake according to the rotation period of the generator 2, and when the rotation period of the generator 2 is as long as 140 ms or longer, constitutes the generator-stop preventing unit 56 for continuing weak-brake control to give priority to preventing the generator 2 from being stopped.

In the present embodiment, the first setting period is set to 140 ms, and the first brake setting value is set to the amount of brake specified by a chopper signal having a duty cycle of 1/16.

According to the present embodiment, the following advantages are obtained.

(1) When the brake-control-signal generating circuit 81 generates the brake-control signal CH3 for controlling the brake of the generator 2, the circuit detects the rotation period of the rotor. When the rotation period is equal to or longer than the first setting period (140 ms), the brake-control signal CH3 is set to an L-level signal, and the generator-stop preventing unit 56 for performing weak-brake control by a chopper signal having a duty cycle of 1/16 is provided. Therefore, even if brake control is applied in a state in which the rotation period is long, the generator is positively prevented from being stopped.

Consequently, a condition in which a brake is applied to such a degree to stop the generator 2 and a duration time becomes shortened is prevented. The duration time of electronically controlled mechanical timepieces is thus maintained as designed.

Furthermore, since a condition in which the generator is stopped and then re-driven does not occur, a time indication error by the hands 4 is eliminated.

(2) When the brake-control-signal generating circuit 81 generates the brake control signal CH3, the circuit 81 uses the compensation signal H01 or H02 selected according to the rotation period of the rotor to adjust the brake control signal, if necessary. Therefore, adjustment can be performed such that the rotation period of the rotor quickly approaches that of the reference signal.

With this adjustment, since the most appropriate brake control is performed according to the rotation period of the generator 2 irrespective of the reference period, a sufficient amount of brake is positively applied, and a response in speed adjustment control can be improved, compared with a case in which brake-on control and brake-off control are always performed in one reference period. Therefore, a variation in the rotation period of the rotor of the generator 2 can be made small, and the generator 2 can be rotated at an almost constant speed stably.

(3) Since the amount of brake is specified for compensation in a rotation period prior to that in which a brake is actually applied, the brake may be too strong when applied, so that the generator 2 is stopped. Therefore, the amount of compensation cannot be dynamically specified. In the present embodiment, since the generator-stop preventing unit 56 is provided, the generator 2 is prevented from being stopped irrespective of the amount of compensation specified. Consequently, the amount of compensation to be applied to the amount of brake can be dynamically specified, and a response in speed adjustment control can be further improved.

(4) Since a chopper signal having a large duty cycle is used for strong-brake control, brake torque can be made large while a reduction in the voltage of the charged circuit is minimized. Efficient brake control is achieved while the stability of the system is maintained. Therefore, the duration of an electronically controlled mechanical timepiece is extended.

(5) Since chopper control is also applied even to weak-brake control with a chopper signal having a small duty cycle, the voltage of the charged circuit obtained when a weak brake is applied can be further increased.

(6) Strong-brake control and weak-brake control are switched only according to whether the count is "7" or less, or "8" or more, the rotation control unit 50 can have a simple structure, and component cost and manufacturing cost can be reduced to provide inexpensive electronically controlled mechanical timepieces.

(7) Since timing when the up-count signal is input is changed according to the rotation speed of the generator 2, a period in which the count is "8," that is, a period in which a brake is applied, can be automatically adjusted. Therefore, especially in a lock state in which the up-count signal and the down-count signal are alternately input, quick-response and stable control is achieved.

(8) Since the up/down counter 60 is used as a brake control unit, pulses in the up-count signal and the down-count signal are counted, and at the same time, a comparison (a difference) between the counts is automatically calculated. Therefore, the difference between the counts can be easily obtained with a simple structure.

(9) Since the four-bit counter 60 is used, 16 counts are obtained. Therefore, when the up-count signal is continuously input, its pulses can be continuously counted. An accumulated error can be compensated within a specified range, that is, until the count reaches "15" or "0" when the up-count signal or the down-count signal is continuously input. Therefore, even if the rotation speed of the generator 2 was largely shifted, it would take time to obtain a lock state, but an accumulated error would be positively compensated to return the rotation speed of the generator 2 to the reference speed, so that a correct hand movement could be maintained in a long term.

(10) Since the initialization circuit 90 is provided so as not to perform brake control, which means not to apply a brake to the generator 2, until the power-supply circuit 6 for the generator 2 is charged to a predetermined voltage at power on, priority is given to charging of the power-supply circuit 6. Therefore, the rotation-control unit 50 can be quickly and stably driven by the power-supply circuit 6, and stability of rotation control obtained thereafter can also be increased.

(11) Since the brake-control-signal generating circuit 81 is formed of various logic circuits, it can be made compact and can have less power consumption. Especially since the rotation-period detection circuit 200 uses the flip-flops 210 to 213, the circuit structure can be made simple and data can be easily used, compared with a case in which another rotation detector is used.

In addition, since the brake-control-signal generating circuit 81 serves as both the brake-amount compensation unit for compensating the amount of brake according to the rotation period of the generator 2, and the generator-stop preventing unit 56 for continuing weak-brake control to give priority to preventing the generator 2 from being stopped, the circuit structure can be made simple and cost is reduced, compared with a case in which these unites are formed by separate circuits.

The present invention is not limited to the above embodiment. The present invention includes modifications and improvements within a range in which objects of the present invention are achieved.

For example, the duty cycles of chopper signals in the chopper-signal generating section 80 are not limited to 1/16 or 15/16, and may have another value, such as 14/16. In addition, it is possible that the duty cycles of the chopper signals be set to 28/32, 31/32, or others and the duty cycles be changed not in 16 stages but in 32 stages. In this case, it is preferred that the duty cycle of a chopper signal used for strong-brake control fall in a range of about 0.75 to 0.97. Within this range, when the duty cycle falls in a range of about 0.75 to 0.89, the voltage of the charged circuit is further increased, and when the duty cycle falls in a high range of about 0.90 to 0.97, brake power is further increased.

In the above embodiment, the duty cycle of the chopper signal used for weak-brake control needs to fall, for example, in a low range of about 1/16 to 1/32. In other words, the duty cycles and frequencies of the chopper signals need to be set appropriately for a specific application of the present invention. When the frequencies are set to those in a high range of 500 Hz to 1000 Hz, for example, the voltage of the charged circuit is further increased. When the frequencies are set to those in a low range of 25 Hz to 50 Hz, brake power is further increased. Therefore, by changing the duty cycles and frequencies of the chopper signals, the voltage of the charged circuit and brake power can be further increased.

The first brake setting value in the generator-stop preventing unit 56 may be set to that used for weak-brake control (corresponding to a chopper signal of which the duty cycle is as low as 1/16 to 1/32), may be a value corresponding to a further smaller amount of brake, or further may be set to a value corresponding to an amount of brake of zero.

Even when the rotation period reaches the first setting period (for example, 140 ms) or longer, the first brake setting value needs to be a value which prevents the generator 2 from being stopped. Specifically, the first brake setting value needs to be specified from an experiment as appropriate according to an electronic unit to which the present invention is applied.

When a chopper signal is switched by the count of the up/down counter 60, the present invention is not limited to a case in which switching is made at three stages in which the count is less than "8," the count is "8," and the count is 9 or more, as in the above-described embodiment, but is also applied to a case in which switching is made at three stages in which the count is less than "8," the count is "8" or "9," and the count is between "10" and "15." These values need to be specified as appropriate to the specific application of the present invention.

The four-bit up/down counter 60 is used as a brake control unit. A three-bit or less up/down counter may be used. Alternately, a five-bit or more up/down counter may be used. When an up/down counter having a large number of bits is used, since the number of countable values increases, a range in which an accumulated error is stored increases. Therefore, a special advantage is given to control in an unlock state such as that obtained immediately after the activation of the generator 2. On the other hand, when an up/down counter having a small number of bits is used, a range in which an accumulated error is stored decreases. Since a count is repeatedly incremented and decremented especially in a lock state, even a one-bit counter can handle the situation and cost is reduced.

As a brake control unit, not only an up/down counter but also a section formed of separate first and second counting units or devices for the reference signal fs and the rotation detection signal FG1, respectively, and a comparison circuit for comparing the counts of the counting units may be used. Using the up/down counter 60 has an advantage in that the circuit structure is simpler.

As a brake control unit, a unit that detects the generated voltage and the rotation period (speed) of the generator 2, and controls a brake according to detected values may also be used. A specific structure thereof can be selected appropriate to the specific application of the present invention.

In the above embodiment, two types of chopper signals having different duty cycles and frequencies are used in strong-brake control. Three or more types of chopper signals having different duty cycles and frequencies may be used. In addition, the duty cycles and frequencies may be changed continuously as in frequency modulation, instead of being changed in a step manner.

When brake control is performed with three or more types of chopper signals or with chopper signals of which the duty cycles and frequencies are continuously changed, the first brake setting value used in generator-stop preventing control needs to be a value corresponding to the smallest amount of brake among those corresponding to brake control signals, or a smaller value.

The value to which the first brake setting value is set is not limited to the value corresponding to the smallest amount of brake. It may be set to a value corresponding to an amount of brake that does not cause the generator 2 to stop even if the amount of brake is larger than the smallest amount of brake.

In the above embodiment, the chopper signals are used to control brake power applied to the rotor. A brake may be controlled without using the chopper signals. For example, a brake may be controlled such that the brake control signal CH3 sent from the brake-control-signal generating circuit 81 is inverted through an inverter to serve as a brake signal CH5, when the brake control signal CH3 has the H level, a brake continues to be applied, and when the brake control signal CH3 has the L level, a brake is turned off.

In this case, the first brake setting value needs to be set to a value corresponding to a brake-off state, that is, to a value corresponding to an amount of brake of zero.

Furthermore, in the above embodiment, the two types of chopper signals are used to perform strong-brake control and weak-brake control. The speed of the generator may be adjusted by strong-brake control employing a chopper signal and brake-off control in which a brake is completely turned off. In this case, the first brake setting value needs to be set to a value corresponding to a brake-off state, that is, to a value corresponding to an amount of brake of zero.

In addition, compensation values specified by the brake-amount compensation circuit 300 are not limited to two-stage values used in the above-described embodiment. A one-stage or more compensation value(s) is needed, and can be selected appropriate to the specific application of the present invention. In the above-described embodiment, compensation is not applied when the rotation period is almost equal to the reference period, and compensation is made when the rotation period is shorter than the reference period and when the rotation period is longer than the reference period. For example, compensation may be performed either when the rotation period is shorter than the reference period or when the rotation period is longer than the reference period. In this case, a one-stage (two stages, including no compensation) compensation value may be used for adjustment. Alternately, two-stage or more compensation values may be used for adjustment. If compensation is performed both when the rotation period is shorter than the reference period and when the rotation period is longer than the reference period as in the above-described embodiment, an advantage is that quicker speed-adjustment control is performed.

A compensation value may be continuously changed according to the rotation period of the generator. In this case, more precise adjustment can be made. If a compensation value is specified in advance as in the above-described embodiment, an advantage is that the structure of the brake-amount compensation circuit 300 is made simple.

The rotation period detected by the rotation-period detection circuit 200 may be appropriately specified according to the compensation stages used.

In addition, specific amounts of compensation achieved by the compensation signals H01 and H02 specified by the brake-amount compensation circuit 300, and a range of the rotation period where the compensation signals are used can be selected appropriate to the specific application of the present invention.

Furthermore, in the present invention, a configuration in which the amount of brake is compensated by the compensation signals H01 and H02 is not necessarily required. Brake control may be performed by using the output QD as is to switch between a brake-on state (including strong-brake control) and a brake-off state (including weak-brake control). Also in this case, irrespective of the brake control, when the rotation period reaches the first setting period or more, the generator-stop preventing unit 56 needs to perform brake-off control to prevent the generator 2 from being stopped.

Specific structures, such as the rectifying circuit 5, the brake circuit 20, the control circuit 53, and the chopper-signal generating section 80, are not limited to those described in the above embodiment. They may be those which can apply brake control to the generator 2 of an electronically controlled mechanical timepiece by chopper control or others. Especially, the structure of the rectifying circuit 5 is not limited to that used in the above embodiment, which employs chopper boosting. It may be, for example, a structure having a boost circuit in which a plurality of capacitors is provided and connections thereof are switched to boost a voltage. It may be selected appropriately for the type of an electronically controlled mechanical timepiece in which the generator 2 and the rectifying circuit are used in.

A switch circuit for making both ends of the generator 2 form a closed loop are not limited to the switches 21 and 22 used in the above embodiment. For example, the switch circuit may be formed such that transistors are connected to resistive elements, the transistors are turned on by a chopper signal to make both ends of the generator 2 form a closed loop, and a resistive element is disposed in the loop. In other words, the switch circuit needs to make both ends of the generator 2 form a closed loop.

The present invention can be applied not only to electronically controlled mechanical timepieces as in the above embodiment, but also to various types of electronic units, such as various types of timepieces, such as table clocks and other clocks, portable timepieces, portable sphygmomanometers, portable telephones, pagers, pedometers, pocket calculators, portable personal computers, electronic pocketbooks, portable radios, music boxes, metronomes, and electric shavers.

When the present invention is applied to a music box, for example, its generator is not stopped, so that the music box can be operated for a long time to provide a correct performance.

When the present invention is applied to a metronome, it needs to have a structure in which a metronome-sound-emitting wheel is connected to a gear in a gear train, and the rotation of the wheel operates a metronome-sound piece to emit a periodic metronome sound. A metronome needs to emit sounds corresponding to various speeds. This can be possible when the period of a reference signal sent from an oscillating circuit is made variable by changing a scaling stage for a crystal oscillator.

The first setting period in which the generator-stop preventing unit 56 is operated is not limited to 140 ms. It needs to be specified appropriately according to the type of an electronic unit to which the present invention is applied.

In a design or manufacturing stage, the first setting period needs to be set to a period between a period at which the generator 2 is stopped unless the amount of brake applied to the generator 2 is actually switched to the first brake setting value, and a period at which the generator 2 vibrates when the amount of brake applied to the generator 2 is switched to the first brake setting value after the periods are obtained by an experiment or others empirical methods.

The mechanical energy source is not limited to a coil spring. It may be rubber, a spring, or a weight. It can be selected appropriate to the application of the present invention.

The energy transfer unit for transferring mechanical energy from the mechanical energy source such as a coil spring to the generator is not limited to a gear train (gear) as in the above-described embodiment. It may be a friction wheel, a belt and pulley, a chain and sprocket wheel, a rack and pinion, or a cam. It can be selected appropriately to the type of an electronic unit to which the present invention is applied.

A rotation control unit according to the present invention may be formed by hardware and embedded in an electronic unit in advance. The rotation control unit may be implemented by software by installing (embedding) a control program through a recording medium such as a CD-ROM or communication channel such as the Internet when an electronic unit is provided with a computer function, namely with a central processing unit (CPU), a memory, and a hard disk.

As described above, in an electronic unit, an electronically controlled mechanical timepiece, a control program for an electronic unit, a recording medium, a control method for an electronic unit, and a method of manufacturing an electronic unit of the present invention, a condition in which brake control stops a generator is positively prevented, a quicker response is provided for speed-adjustment control, and stable control is performed.

What is claimed is:

1. An electronic unit comprising a mechanical energy source, a generator driven by the mechanical energy source to generate induction electric power to supply electrical energy, and a rotation control unit driven by the electrical energy to control the rotation period of the generator, the rotation control unit comprising:

a brake control unit that compares a reference signal, generated according to a signal sent from a time reference source, with a rotation detection signal corresponding to the rotation period of the generator to apply brake control to the generator; and a generator-stop preventing unit that sets the amount of brake applied to the generator to only a first brake setting value when a measured rotation period of the generator is equal to or longer than a first setting period, which is longer than a reference period, to prevent the generator from stopping.

2. An electronic unit according to claim 1, wherein the first brake setting value is set to a value that makes the amount of brake applied zero.

3. An electronic unit according to claim 1, wherein the first brake setting value is set to a value equal to or less than a minimum amount of brake selected from among a plurality of amounts of brake that can be set in the brake control unit.

4. An electronic unit according to claim 1, wherein the generator-stop preventing unit sets the amount of brake applied to the generator to the first brake setting value in synchronization with the rotation period of the generator.

5. An electronically controlled mechanical timepiece comprising a mechanical energy source, a generator driven by the mechanical energy source to generate induction electric power to supply electrical energy, a rotation control unit driven by the electrical energy to control the rotation period of the generator, and a time indication unit operated with the rotation of the generator, the rotation control unit comprising:

a brake control unit that compares a reference signal, generated according to a signal sent from a time reference source, with a rotation detection signal corresponding to the rotation period of the generator to apply brake control to the generator; and a generator-stop preventing unit that sets the amount of brake applied to the generator to only a first brake setting value when a measured rotation period of the generator is equal to or longer than a first setting period, which is longer than a reference period, to prevent the generator from stopping.

6. A control program for an electronic unit comprising a mechanical energy source, a generator driven by the mechanical energy source to generate induction electric power to supply electrical energy, and a rotation control unit driven by the electrical energy to control the rotation period of the generator, the control program for the electronic unit controlling the rotation control unit to:

compare a reference signal, generated according to a signal sent from a time reference source, with a rotation detection signal corresponding to the rotation period of the generator to apply brake control to the generator; and set the amount of brake applied to the generator to only a first brake setting value when a measured rotation period of the generator is equal to or longer than a first setting period, which is longer than a reference period, to prevent the generator from stopping.

7. A recording medium recording a control program for an electronic unit comprising a mechanical energy source, a generator driven by the mechanical energy source to generate induction electric power to supply electrical energy, and a rotation control unit driven by the electrical energy to control the rotation period of the generator, the recorded control program for the electronic unit controlling the rotation control unit to:

compare a reference signal, generated according to a signal sent from a time reference source, with a rotation detection signal corresponding to the rotation period of the generator to apply brake control to the generator; and set the amount of brake applied to the generator to only a first brake setting value when a measured rotation period of the generator is equal to or longer than a first setting period, which is longer than a reference period, to prevent the generator from stopping.

8. A control method for an electronic unit comprising a mechanical energy source, a generator driven by the mechanical energy source to generate induction electric power to supply electrical energy, and a rotation control unit driven by the electrical energy to control the rotation period of the generator, the control method comprising:

comparing a reference signal, generated according to a signal sent from a time reference source, with a rotation detection signal corresponding to the rotation period of the generator to apply brake control to the generator; and setting the amount of brake applied to the generator to only a first brake setting value when a measured rotation period of the generator is equal to or longer than a first setting period, which is longer than a reference period, to prevent the generator from stopping.

9. A method for manufacturing an electronic unit comprising a mechanical energy source, a generator driven by the mechanical energy source to generate induction electric power to supply electrical energy, and a rotation control unit driven by the electrical energy to control the rotation period of the generator, the method comprising:

selecting as an upper limit a period at which the generator is stopped unless the amount of brake applied to the generator is switched to a first brake setting value, selecting as a lower limit a period at which the generator vibrates when the amount of brake applied to the generator is switched to the first brake setting value, and setting a first setting period to a period between the upper limit and the lower limit, such that the electronic unit operates to:

compare a reference signal, generated according to a signal sent from a time reference source, with a rotation detection signal corresponding to the rotation period of the generator to apply brake control to the generator; and set the amount of brake applied to the generator to only the first brake setting value when a measured rotation period of the generator is equal to or longer than the first setting period, which is longer than a reference period, to prevent the generator from stopping.

10. An electronic unit comprising a mechanical energy source, a generator driven by the mechanical energy source to generate induction electric power to supply electrical energy, and a rotation control unit driven by the electrical energy to control the rotation period of the generator, the rotation control unit comprising:

brake control means for comparing a reference signal, generated according to a signal sent from a time reference source, with a rotation detection signal corresponding to the rotation period of the generator to apply brake control to the generator; and generator-stop preventing means for setting the amount of brake applied to the generator to only a first brake setting value when a measured rotation period of the generator is equal to or longer than a first setting period, which is longer than a reference period, to prevent the generator from stopping.

* * * * *